US009379453B2

(12) United States Patent
Rentz

(10) Patent No.: US 9,379,453 B2
(45) Date of Patent: Jun. 28, 2016

(54) ANTENNA FOR A SATELLITE NAVIGATION RECEIVER

(71) Applicant: Deere & Company, Moline, IL (US)

(72) Inventor: Mark L. Rentz, Torrance, CA (US)

(73) Assignee: DEERE & COMPANY, Moline, IL (US)

( * ) Notice: Subject to any disclaimer, the term of this patent is extended or adjusted under 35 U.S.C. 154(b) by 442 days.

(21) Appl. No.: 13/854,452

(22) Filed: Apr. 1, 2013

(65) Prior Publication Data

US 2014/0176386 A1 Jun. 26, 2014

Related U.S. Application Data

(60) Provisional application No. 61/739,899, filed on Dec. 20, 2012.

(51) Int. Cl.

| | |
|---|---|
| ***H01Q 21/06*** | (2006.01) |
| ***H01Q 1/50*** | (2006.01) |
| ***H01Q 19/18*** | (2006.01) |
| ***H01Q 1/36*** | (2006.01) |
| ***H01Q 21/24*** | (2006.01) |

(52) U.S. Cl.

CPC ..... *H01Q 21/065* (2013.01); *H01Q 1/36* (2013.01); *H01Q 1/50* (2013.01); *H01Q 19/18* (2013.01); *H01Q 21/24* (2013.01)

(58) Field of Classification Search

CPC ..... H01Q 21/24; H01Q 21/065; H01Q 1/36
See application file for complete search history.

(56) References Cited

U.S. PATENT DOCUMENTS

| | | | | |
|---|---|---|---|---|
| 5,173,711 | A * | 12/1992 | Takeuchi et al. | 343/700 MS |
| 6,057,802 | A * | 5/2000 | Nealy et al. | 343/700 MS |
| 6,259,407 | B1 | 7/2001 | Tran | |
| 6,993,259 | B2 | 1/2006 | Huang et al. | |
| 7,342,553 | B2 | 3/2008 | Soler Castany et al. | |
| 7,812,767 | B2 | 10/2010 | Seki et al. | |
| 8,217,850 | B1 | 7/2012 | Jennings et al. | |
| 2006/0164305 | A1 | 7/2006 | Chen et al. | |
| 2009/0322631 | A1 * | 12/2009 | Huchard et al. | 343/720 |
| 2010/0295750 | A1 | 11/2010 | See et al. | |
| 2011/0193761 | A1 | 8/2011 | Shinkai et al. | |
| 2012/0050122 | A1 | 3/2012 | Wu et al. | |
| 2013/0201066 | A1 * | 8/2013 | Parsche | 343/743 |

FOREIGN PATENT DOCUMENTS

| | | |
|---|---|---|
| EP | 0540125 | 5/1993 |

OTHER PUBLICATIONS

International Search Report dated Mar. 10, 2014.

* cited by examiner

*Primary Examiner* — Robert Karacsony

(57) ABSTRACT

An antenna comprises notched semi-elliptical radiators. Each of the radiators has a first substantially planar surface. A ground plane has a second substantially planar surface that is generally parallel to the first substantially planar surfaces of the radiators by a generally uniform spacing. The ground plane has a central axis. Feeding members are adapted for conveying an electromagnetic signal to or from each radiator. Each of the feeding members is spaced radially outward from the central axis of the ground plane. A grounded member is coupled to each radiator and spaced apart, radially outward from the feeding spacer.

25 Claims, 11 Drawing Sheets

ANTENNA FOR A SATELLITE NAVIGATION RECEIVER

RELATED APPLICATION

This document (including the drawings) claims priority and the benefit of the filing date based on U.S. provisional application No. 61/739,899, filed Dec. 20, 2012 under 35 U.S.C. §119 (e), where the provisional application is hereby incorporated by reference herein.

FIELD OF THE DISCLOSURE

This disclosure relates to an antenna for a satellite navigation receiver.

BACKGROUND

Satellite navigation receivers refer to location-determining receivers, such as a Global Positioning System (GPS) receiver, a Global Navigation Satellite System (GLONASS) receiver, or a Galileo receiver, for example. A satellite navigation receiver requires an antenna to receive one or more satellite signals that are transmitted by one or more satellite transmitters of satellite vehicles that orbit about Earth. Certain prior art antennas do not provide adequate reception of satellite signals at low elevation angles. Reception of satellite signals at low elevation angles is particularly important if satellite receivers are operated at high latitudes (e.g., in the Arctic). Accordingly, there is need for an antenna that provides suitable reception and gain of one or more satellite signals over a targeted range of elevation angles.

SUMMARY

In accordance with one embodiment, an antenna comprises notched semi-elliptical radiators. Each of the radiators has a first substantially planar surface. A ground plane has a second substantially planar surface that is generally parallel to the first substantially planar surfaces of the radiators by a generally uniform spacing. The ground plane has a central axis. Feeding members are adapted for conveying an electromagnetic signal to or from each radiator. Each of the feeding members is spaced radially outward from the central axis of the ground plane. A grounded member is coupled to each radiator and spaced apart, radially outward from the feeding spacer.

DESCRIPTION OF ILLUSTRATIVE EMBODIMENT(S)

Figure 1A:
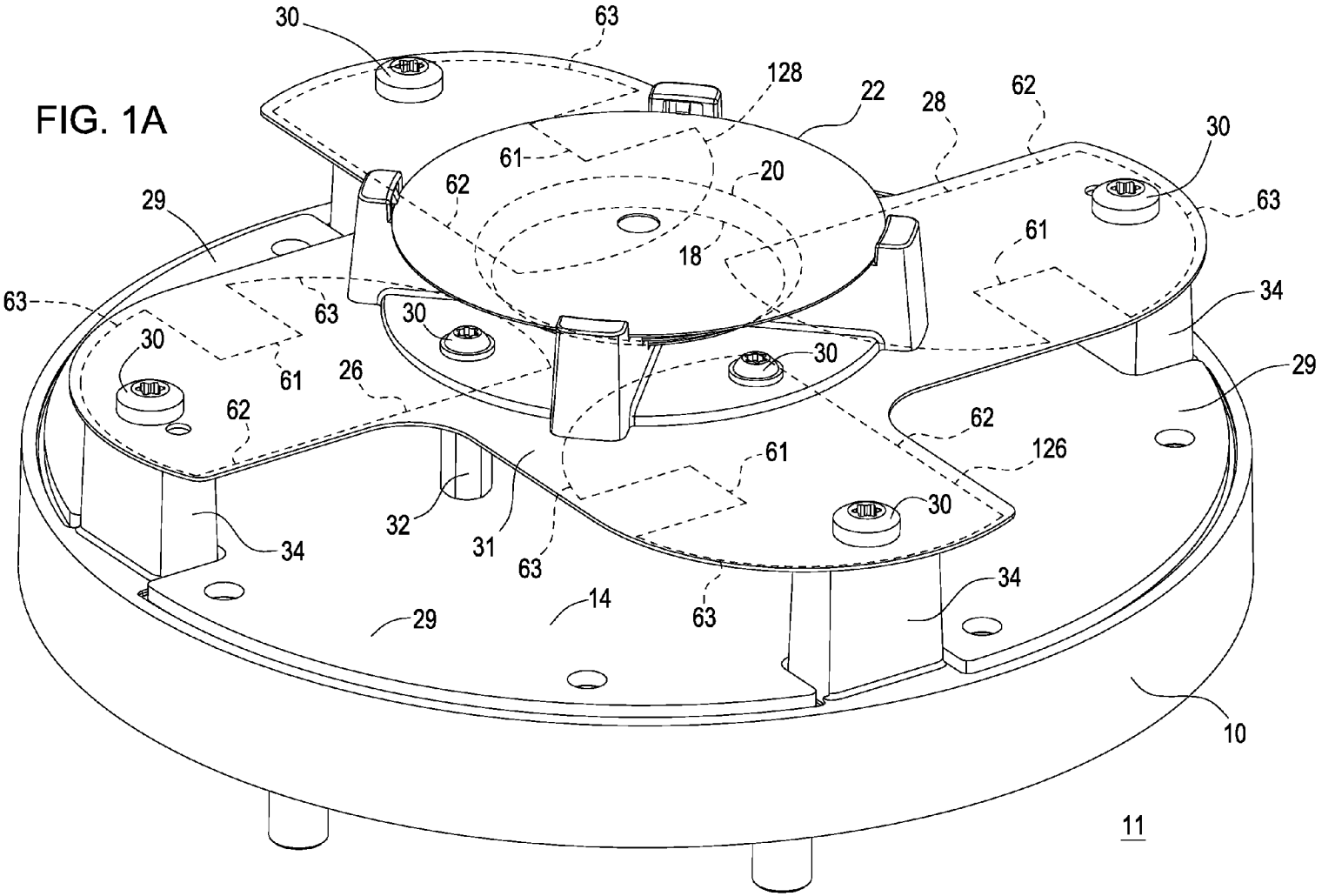
FIG. 1A is a perspective view of one embodiment of the antenna.
Figure 1B:
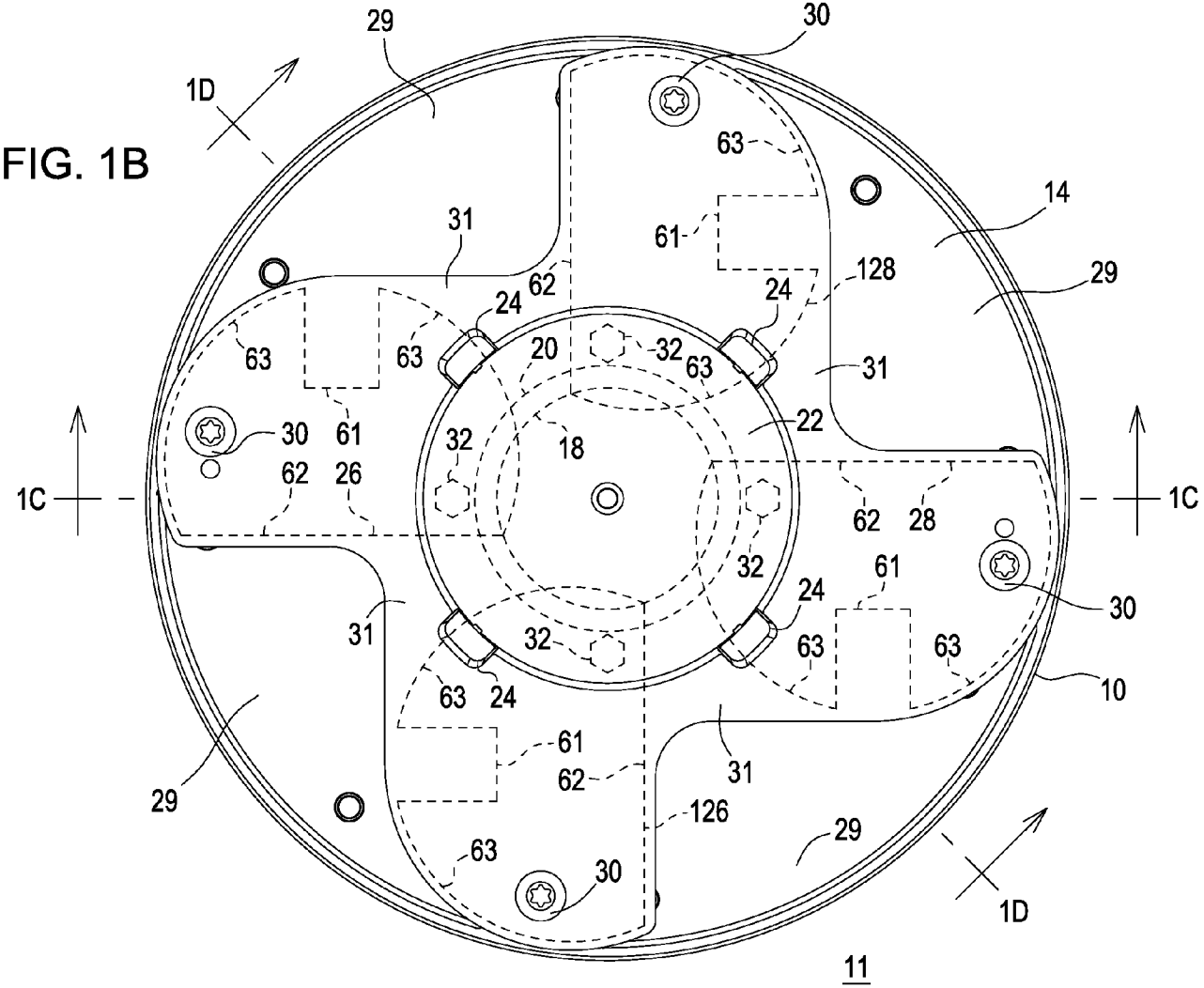
FIG. 1B is a plan view of the antenna of FIG. 1A.
Figure 1C:
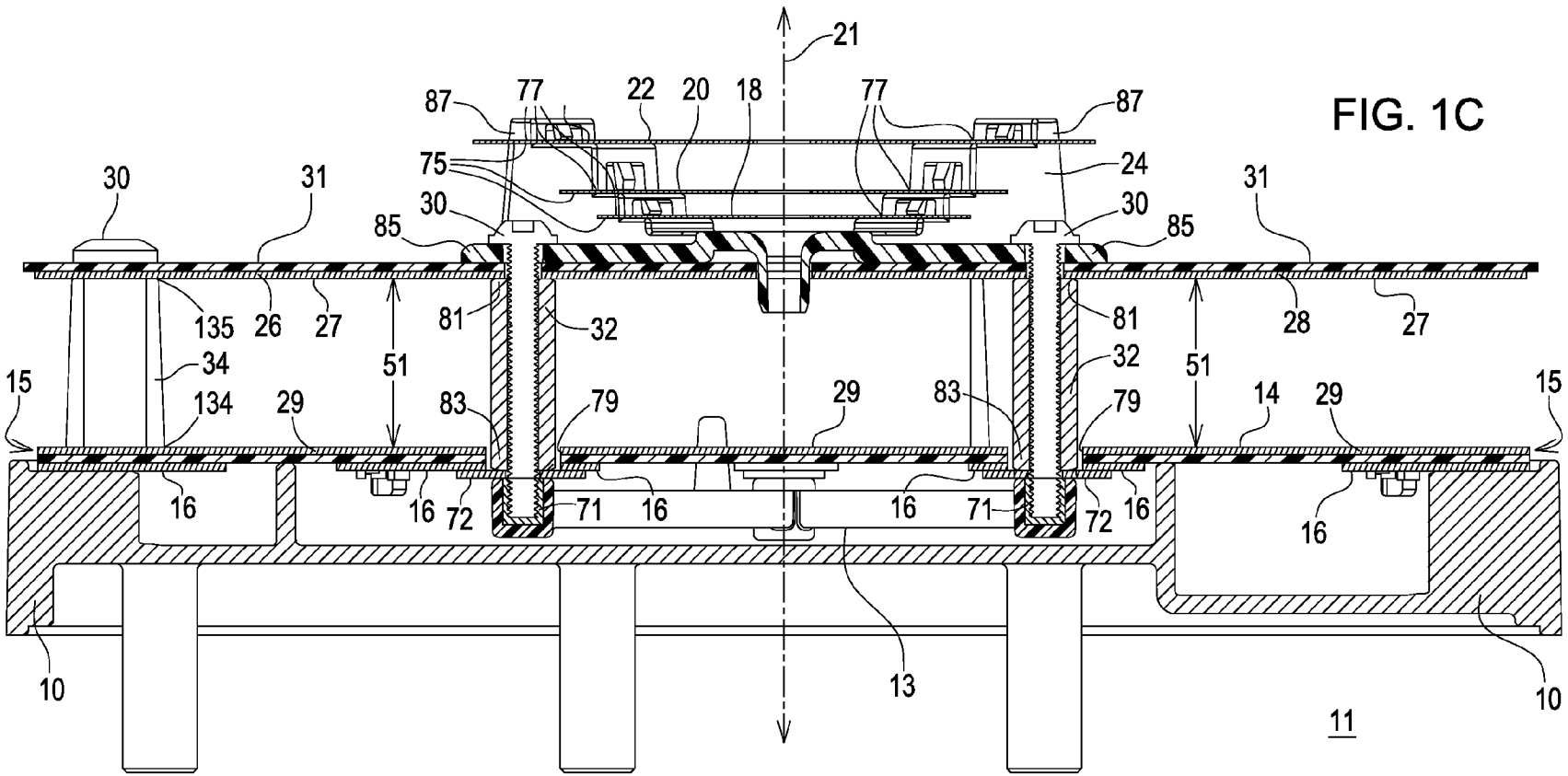
FIG. 1C is a cross-sectional side view of the antenna along reference line 1C-1C in FIG. 1B.
Figure 1D:
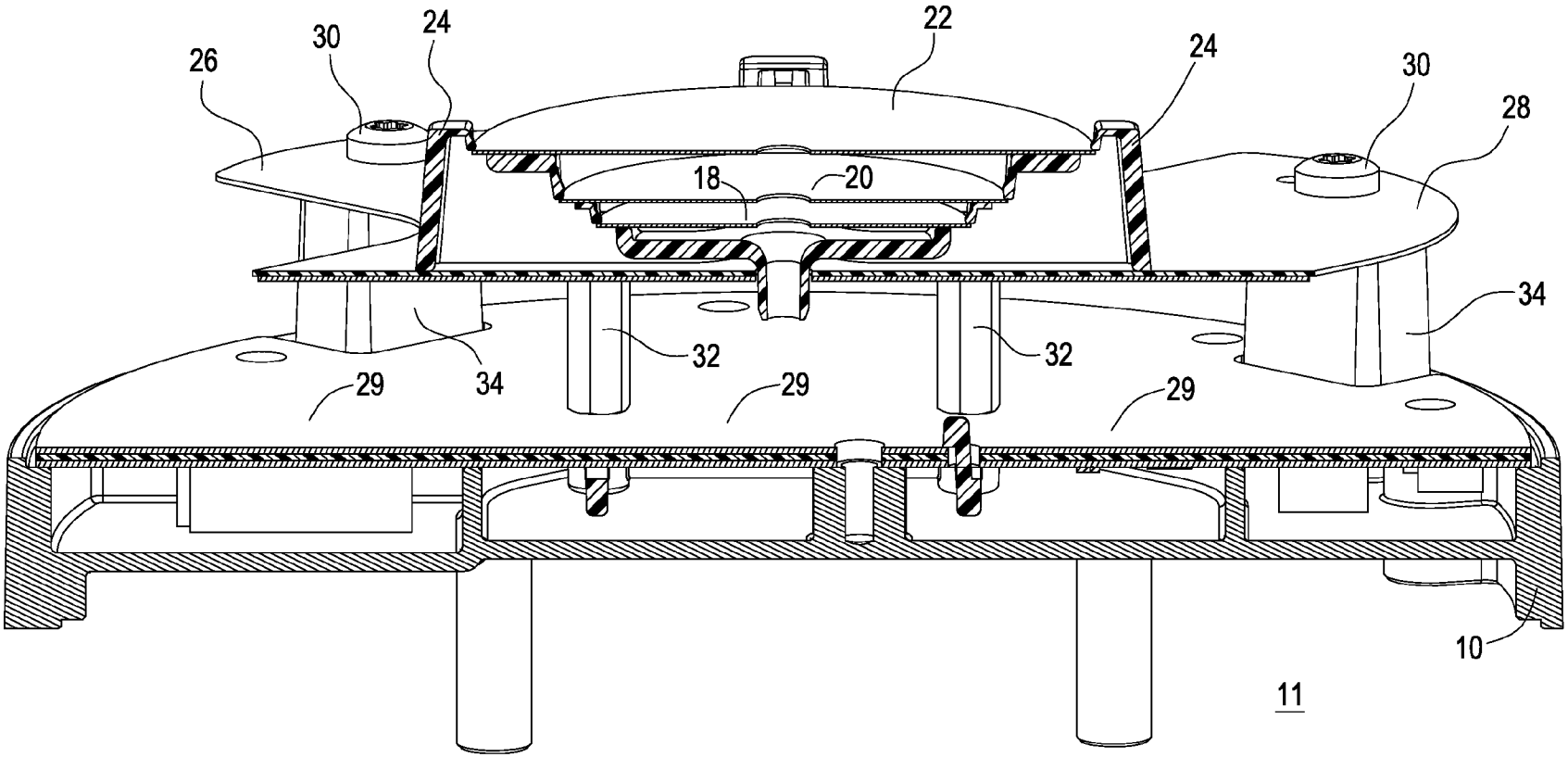
FIG. 1D is perspective view of the antenna along reference line 1D-1D in FIG. 1B.

In accordance with one embodiment, FIG. 1A through FIG. 1E, inclusive, illustrate an antenna 11. For example, the antenna 11 comprises a group of spatially offset and differently oriented radiators (26, 28, 126, 128), such as notched semi-elliptical radiators. Each of the radiators (26, 28, 126, 128) has a first substantially planar surface 27 (e.g., as illustrated in FIG. 1C). A ground plane 14 has a second substantially planar surface 29 that is generally parallel to the first substantially planar surfaces 27 of the radiators (26, 28, 126, 128) by a generally uniform spacing 51 (as shown in FIG. 1C). The ground plane 14 has a central axis 21. Feeding members 32 are adapted for conveying an electromagnetic signal to or from each radiator (26, 28, 126, 128), or to and from each radiator. Each of the feeding members 32 is spaced radially outward from the central axis 21 of the ground plane 14. Each feeding member 32 is coupled to or electrically coupled to a respective radiator, among the radiators (26, 28, 126, 128). A grounded member 34 is coupled to or electrically coupled to each radiator (26, 28, 126, and 128) and spaced apart, radially outward from the feeding member 32.

In one embodiment, one or more parasitic reflectors (18, 20, and 22) are spaced apart axially from the ground plane 14 and the radiators (26, 28, 126 and 128). Although three parasitic reflectors (18, 20, 22) are illustrated in the embodiment of FIG. 1A through FIG. 1E, inclusive, in other embodiments one parasitic reflector may be used. In an alternate embodiment, the parasitic reflectors (18, 20, 22) may be omitted.

Radiators

A radiator (26, 28, 126, and 128) refers to a radiating element, or an electrically conductive radiating element, that receives or transmits an electromagnetic signal, such as an electromagnetic signal transmitted from a satellite navigation system, a satellite transmitter, or a satellite transceiver. The radiator (26, 28, 126, 128) may comprise a modified disk-loaded monopole, for example. In one embodiment, the radiators (26, 28, 126, 128) are arranged to provide phase-offset signal components of a received electromagnetic signal by relative orientation of each radiator with respect to an adjacent radiator in a clockwise or counter-clockwise direction about a central axis 21 of the antenna 11 or the ground plane 14, where the clockwise or counterclockwise direction is observed from a viewpoint above the antenna 11. As shown in FIG. 1B, a curved edge 63 of each of the radiators (26, 28, 126, 128) faces clockwise about a central axis 21 of the antenna 11, where a rectilinear edge 62 of each of the radiators (26, 28) is opposite or adjoins the curved edge 63. The clockwise orientation of the curved edges 63 of the radiators predispose the antenna 11 to favor stronger reception of right-hand circularly polarized signals, for example. The curved edge 63 has a notch 61 (e.g., a generally rectangular notch) or cut-out portion, where the curved edge 63 is generally elliptical or generally circular. As shown, the notch 61 is centrally positioned or centered in the curved edge 63. In an alternate embodiment, the curved edge 63 of each radiator can face counterclockwise, particularly if there is preference to receive left hand circularly polarized (LHCP) signals over right hand circularly polarized (RHCP) signals.

In one embodiment, the radiators (26, 28, 126, 128) may be embedded in, encapsulated in, molded in, or affixed to a generally planar member 31. The generally planar member 31 comprises a dielectric layer or a substantially planar printed wiring board that is composed of a dielectric material. As illustrated, the planar member 31 may be generally shaped a like a disc with dielectric material removed or absent from the periphery where it is not essential to support the radiators. In alternate embodiment, the planar member may be substantially disc-shaped.

In one embodiment, each radiator (26, 28, 126, 128) or individual radiating element may be embodied or modeled as a disk-loaded monopole (DLM) or a modified disk-loaded monopole because it lends itself to be tailored to be approximately resonant over the frequency bands of interest. For microwave frequencies or for reception of satellite navigation signals (e.g., Global Positioning Satellite (GPS) signals), the generally uniform spacing 51 between the ground plane 14 and the radiators (26, 28, 126, 128) is approximately 14 millimeters (mm) and the diameter of the ground plane 14 is approximately 120 millimeters (mm), although other configurations fall within the scope of the disclosure and claims.

In one embodiment, the radiator (26, 28, 126, 128) may comprise a modified disk-loaded monopole, where modified means that there are one or more of the following modifications to a conventional or typical disk-loaded monopole: (1) each disk is truncated such that it has only one slot 61, (2) the two feed structures (e.g., feeding member 32 and grounding spacer 34) are offset from the central axis 21, and (3) the feeding members 32 have substantially circular, elliptical or polygonal cross-sections (e.g., hexagonal) and the grounded members 34 have generally rectangular cross sections, respectively. For example, the feeding members 32 (e.g., radially inward hexagonal structures) are driven and the grounded members 34 (e.g., radially outward rectangular structures) are electrically connected or coupled to the ground plane 14. The truncation of the disks (with slots 61) and the offsetting of the feeds (32, 34) facilitate an improved axial ratio (AR) of the overall antenna 11 when the radiators (26, 28, 126, 128) are driven to produce right hand circular polarization (RHCP) radiation. If the radiators (26, 28, 126, 128), as oriented in FIG. 1A, were driven to produce LHCP radiation the AR would be degraded. The axial ratio is the ratio of amplitude of orthogonal components of an electromagnetic field with circular polarization. Ideally, a circularly polarized signal has orthogonal electromagnetic field components of equal amplitude that are 90 degrees out of phase. Because the components are equal magnitude, the axial ratio can be one (1) or 0 Decibels (dB) for the main beam of the antenna 11. However, the antenna 11 may have different axial ratio as performance can degrade from a main beam or lobe of any antenna 11.

Parasitic Reflectors

In one configuration, the antenna 11 comprises one or more parasitic reflectors (18, 20, 22) are generally elliptical or generally circular. In another configuration, there is a set of reflectors (18, 20, 22) that have different radiuses. In still another configuration, the set of reflectors comprises a first reflector 18, a second reflector 20 and a third reflector 22 spaced axially apart from each other, where the first reflector 18 has a smaller radius than the second reflector 20 and where the second reflector 20 has a smaller radius than the third reflector 22.

In an alternate embodiment, the parasitic reflectors (18, 20, 22) are omitted or eliminated from the antenna 11 or the antenna system. However, such omission or elimination of one or more parasitic reflectors can cause a degradation in the AR of the antenna.

The parasitic reflectors (18, 20, 22) are composed of metallic material, metal, an alloy or other electrically conductive material positioned about a central axis 21 or above a central region of the antenna 11 about the central axis 21. The parasitic reflectors (18, 20, 22) are located above a portion of the radiators (26, 28, 126, 128). One purpose of the parasitic reflectors (18, 20, 22) is to provide a controlled coupling between the radiators (26, 28, 126, 128) or radiating elements such that the axial ratio (AR) is improved. The vertical spacing and diameter of the parasitic reflectors (18, 20, 22) affects the how much the AR can be reduced, but in general when the disks are positioned lower, the impedance deviates farther from the target impedance (e.g., desired 50 ohms). More disks or fewer disks can be used for the parasitic reflectors, but during testing in the global navigation satellite system (GNSS) frequency bands little improvement was observed with more than three parasitic reflectors (18, 20, 22) or passive disks. In one configuration for reception of one or more Global Positioning System (GPS) signals transmitted from space vehicles or satellites, the disks have diameters of approximately 30 mm, approximately 36 mm and approximately 50 mm from lowest to highest, respectively, although other dimensions can fall within the scope of the claims.

Supporting Structure

In one embodiment, a dielectric supporting structure 24 supports one or more parasitic reflectors (18, 20, 22) above a central portion about the central axis 21 of the antenna 11 or spaced apart from the radiators. The parasitic reflector or reflectors (18, 20, 22) may be supported by a dielectric supporting structure 24 or body that is associated with the perimeter or periphery of each parasitic reflector (18, 20, 22). For example, as illustrated in FIG. 1B and FIG. 1C the dielectric supporting structure 24 may have slots or recesses 75 that engage the perimeter portion or periphery portion 77 of each parasitic reflector.

In one configuration, the supporting body 24 comprises a base 85 that has protruding supports 87 (e.g., stepped protruding supports) extending from the base 85, where each protruding support contains the slots or recesses 75 that engage the perimeter portion or periphery portion 77 of each parasitic reflector.

Advantageously, the supporting body 24 facilitates protection or protects the perimeter portion of the parasitic reflector (18, 20, 22), to prevent bending or movement of the periphery of the parasitic reflector (18, 20, 22) that might otherwise affect tuning or the coupling affect between each parasitic reflector (18, 20, 22) and a radiator (26, 28, 126, 128).

Ground Plane

The ground plane 14 may comprise any generally planar surface 29 that is electrically conductive. For example, the ground plane 14 may comprise a generally continuous metallic surface of a substrate or circuit board 15. In one embodiment, the electrically conductive material comprises a metallic material, a metal, or an alloy. In one embodiment, the ground plane 14 is generally elliptical or circular with a generally uniform thickness. In other embodiments, the ground plane 14 may have a perimeter that is generally rectangular, polygonal or shaped in other ways.

In an alternate embodiment, the ground plane 14 may be constructed from a metal screen or metallic screen, such as metal screen that is embedded in, molded or encapsulated in a polymer, a plastic, a polymer matrix, a plastic matrix, a composite material, or the like.

Grounded Members

In one embodiment, the grounded member 34 has a generally rectangular cross section, although other polygonal or other geometric shapes may work and can fall within the scope of the claims. Each grounded member 34 may comprise a spacer. Each grounded member 34 is mechanically and electrically connected to the ground plane 14 and a corresponding radiator (26, 28, 126, 128). For example, a first end 134 (e.g., lower end) of each grounded member 34 is connected to the ground plane 14, whereas a second end 135 of each grounded member 34 is connected to the corresponding radiator (26, 28, 126, 128). In one embodiment, the grounded members 34 are positioned radially outward from the feeding members 32 with respect to the central axis 21.

Feeding Members

The feeding member 32 is electrically insulated or isolated from the ground plane 14. In one example, an air gap or a clearance is established between the feeding members 32 and an opening 79 the ground plane 14 of the circuit board 15. In another example, an insulator or insulating ring may be placed between the feeding member 32 and an opening 79 in the ground plane 14. As illustrated in FIG. 1C, a first end 81 (e.g., upper end) of each feeding member 32 is mechanically and electrically connected to a corresponding radiator (26, 28, 126, 128). For example, the radiator (26, 28, 126, 128) may have a recess for receiving the feeding member 32, where the recess has a cross-sectional shape (e.g., substantially hexagonal shape) corresponding substantially to the size and shape of the feeding member 32, or a protrusion located thereon. In one embodiment, the feeding member 32 has a generally polygonal cross section with five or more sides, such as a substantially pentagonal or a substantially hexagonal cross-section. Accordingly, the recess (e.g., substantially polygonal recess) in a corresponding radiator may engage or mate with the generally polygonal cross section. In another embodiment, the feeding member has a generally circular cross section. In one configuration, the recess is soldered to the generally polygonal cross section or bonded with conductive adhesive. The feeding member 32 is composed of metal, a metallic material, an alloy or another electrically conductive material.

As illustrated in FIG. 1C, a second end 83 (e.g., lower end) of each feeding member 32 is opposite the first end 81. The second end 83 is electrically connected to one or more conductive traces 16 of a circuit board 15, for instance. The conductive traces 16 may be associated with an impedance matching network 507 (in FIG. 5), which will be described in detail later this disclosure. In one illustrative configuration, the conductive traces 16 provide a transmitted signal to the antenna 11 or convey a received signal to a receiver coupled to the antenna 11. At the second end 83, the electrically conductive ring 72 and fastener (e.g., threaded electrically conductive insert or embedded metallic nut) may support the formation of an electrical connection or path between the radiators (26, 28, 126, 128) and impedance matching network 507 or other circuitry on the circuit board 75.

Figure 5:
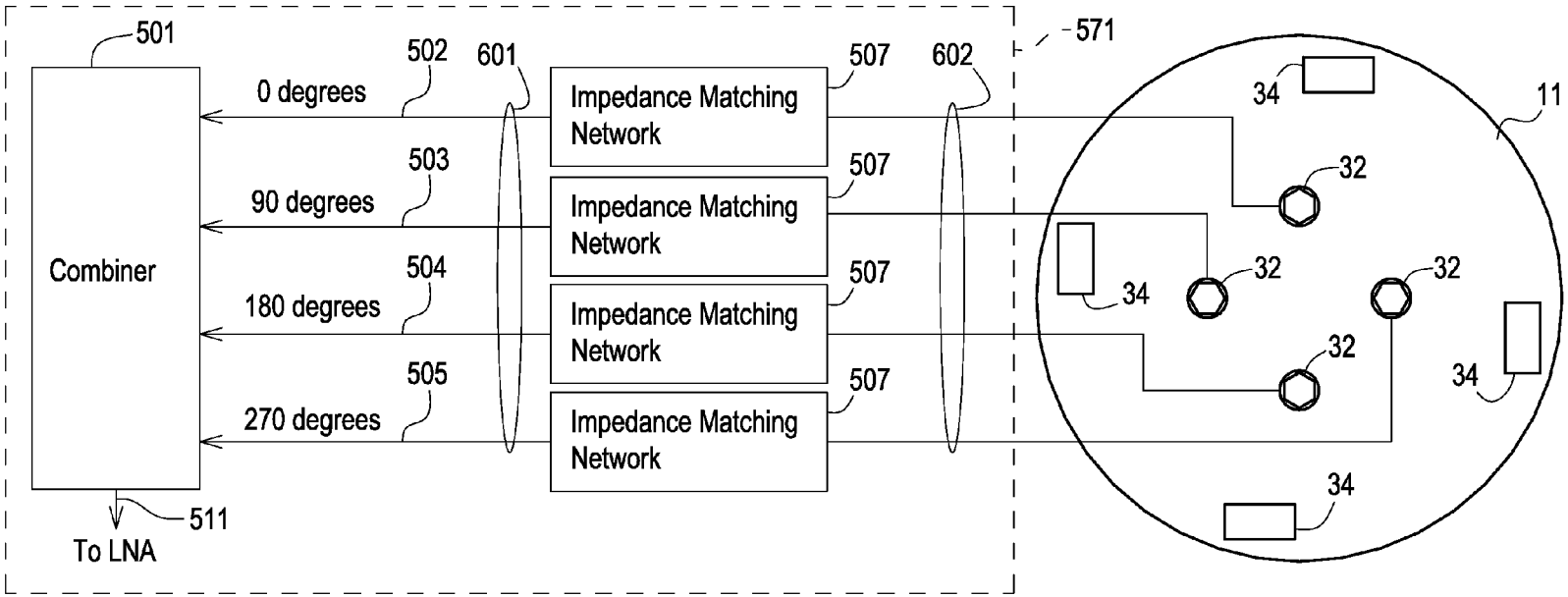
FIG. 5 is a block diagram of an antenna system consistent with the antenna of FIG. 1A.

In FIG. 1A through 1D, inclusive, the antenna 11 uses four radiators (26, 28, 126, 128) or radiating elements individually driven by four received signals, where each received signal differs in phase by 90 degrees from the adjacent signal or signals. For example, FIG. 5 illustrates the antenna 11 in a reception mode where the signal inputted from each radiator (26, 28, 126, 128) or antenna element is 90 degrees out of phase with respect to adjacent signals. Similarly, in a transmission mode or a dual transmission and reception mode, a transmitted signal can be inputted to each radiator is 90 degrees out of phase with respect to the adjacent signals.

Figure 1E:
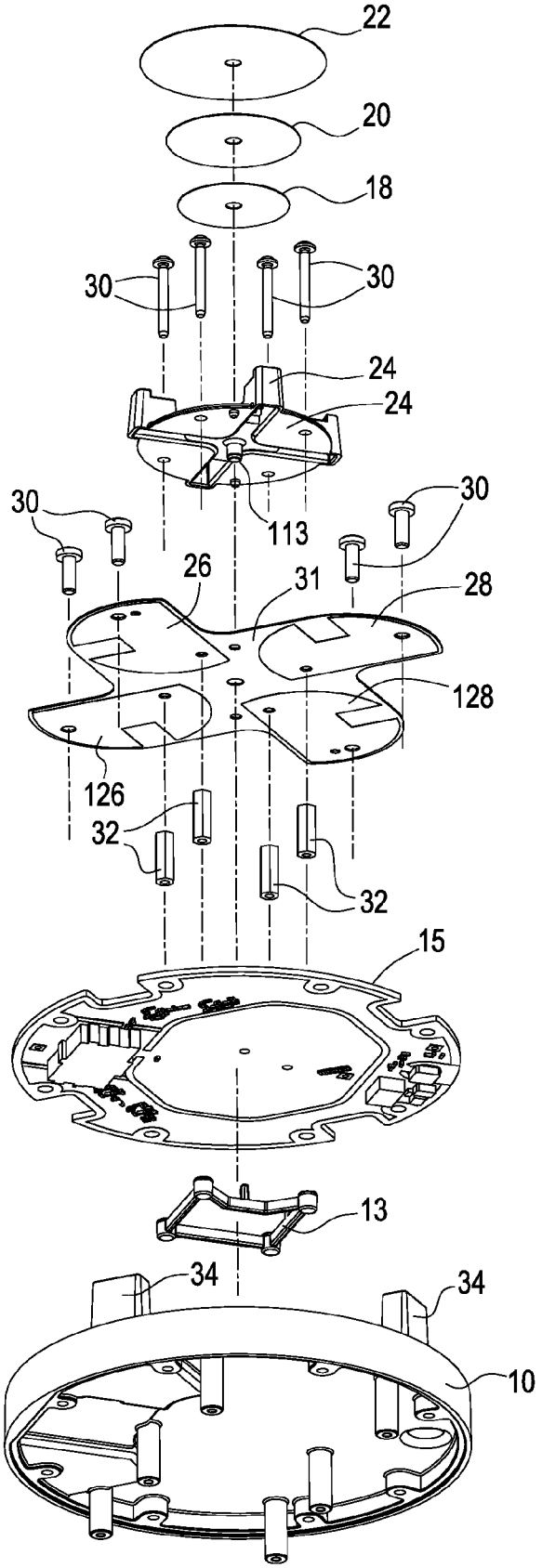
FIG. 1E is an exploded perspective view of the antenna of FIG. 1A.

FIG. 1E shows an exploded view of the antenna 11. The antenna may include an optional frame 13 that aligns with a central bore 113 in the supporting structure 24 or its base 85 to facilitate alignment of the fasteners 30 with fasteners 71 (e.g., threaded inserts) embedded in the optional frame 13, or threaded bores in the optional frame 13.

Figure 2:
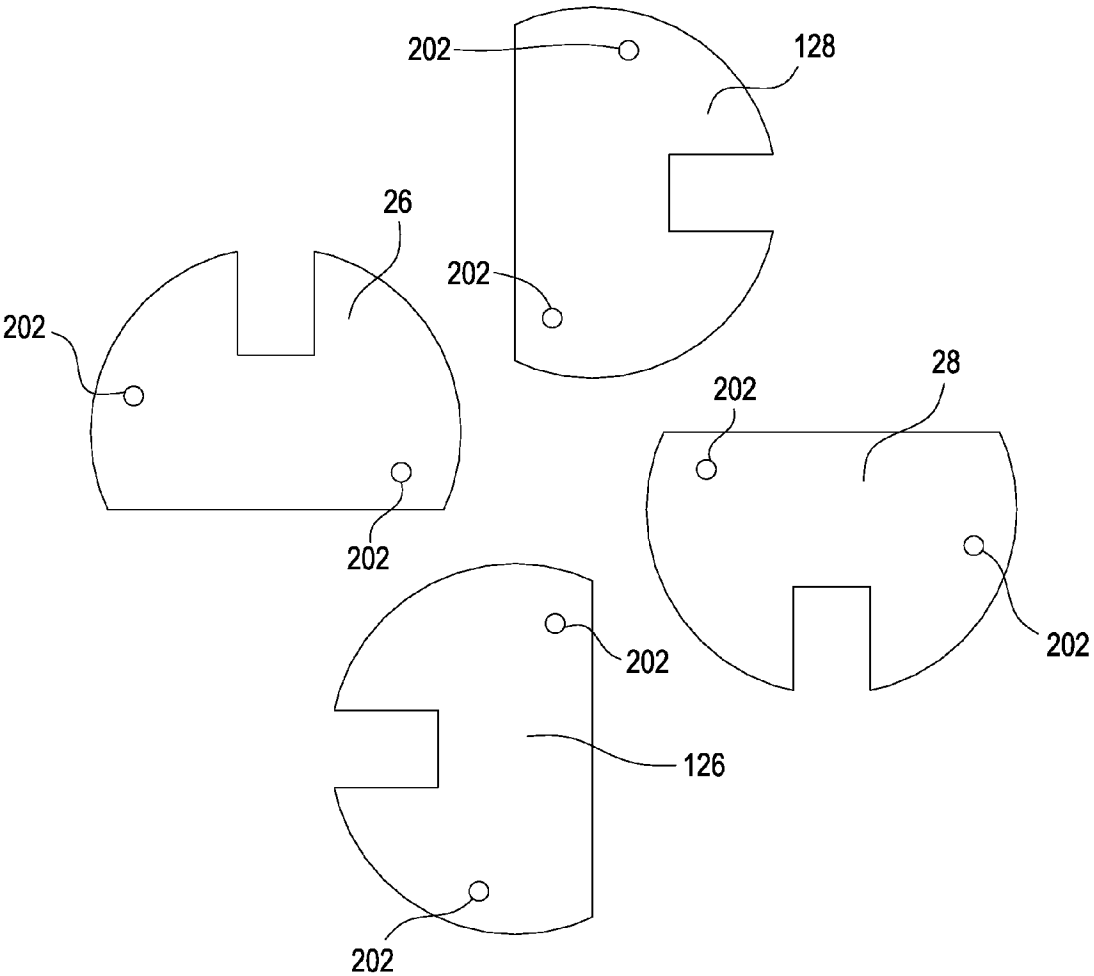
FIG. 2 is an alternate embodiment of radiators that can be substituted for the radiators of FIG. 1A.

FIG. 2 is diagram of an alternative embodiment of the radiator assembly that deletes the generally planar member 31 such that radiators (26, 28, 126, 128) are exposed. Like reference numbers in FIG. 1A through FIG. 1E and FIG. 2 indicate like elements.

The radiators (26, 28, 126, 128) of FIG. 2 are not embedded or affixed to any dielectric plane. Instead, the radiators (26, 28, 126, 128) may comprise generally planar antenna 11 elements composed of electrically conductive material, with the relative orientation of the radiators (26, 28, 126, 128) in the horizontal plane as shown in FIG. 2. The radiators (26, 28, 126, 128) may be coextensive with the plane of the sheet of FIG. 2. Each radiator (26, 28, 126, 128) may have one or more mounting holes 202 such that fasteners 30 can secure the radiator to the antenna 11 or a portion of the antenna 11.

Figure 3:
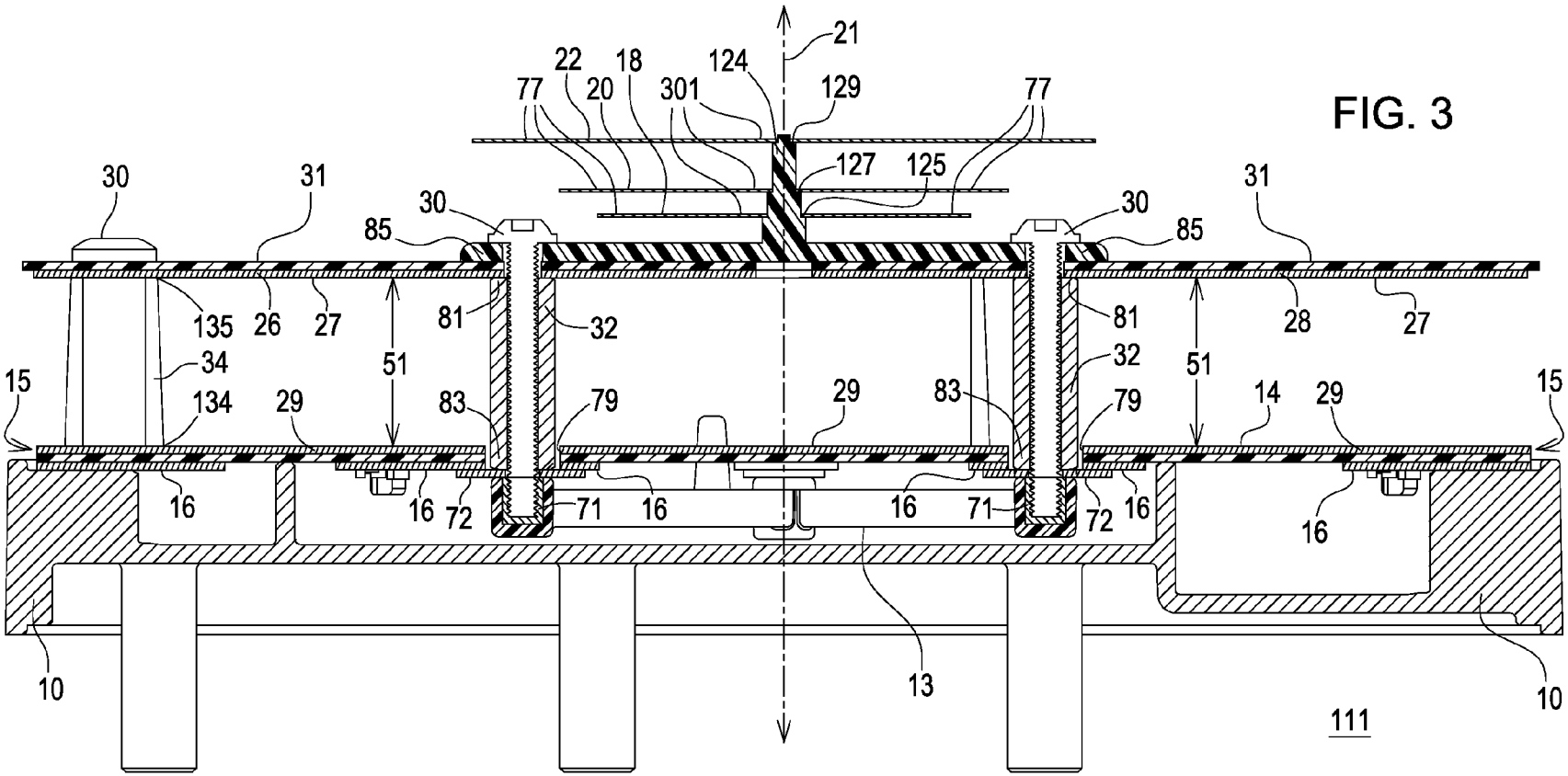
FIG. 3 is one alternate embodiment of a supporting structure for the parasitic reflectors.

The antenna 111 of FIG. 3 is similar to the antenna 11 of FIG. 1A through 1E, inclusive, except the supporting structure 24 of FIG. 1C is replaced by an alternate supporting structure 124. Like reference numbers in FIG. 1A through FIG. 1E, inclusive, and FIG. 3 indicate like elements.

In FIG. 3, the parasitic reflector or reflectors (18, 20, 22) may be supported by a dielectric supporting structure 124 that is associated with or affixed to a central region 301 (e.g., central bore) of each parasitic reflector. Each parasitic reflector (18, 20, 22) may be affixed to a central dielectric supporting structure 124 at its central bore 301 via a press-fit or at its central bore 301 and a respective step (125, 127, 129) in the supporting structure 124.

In one configuration, the dielectric supporting structure 124 comprises a central post with steps (125, 127, 129), where each step is configured to support or secure a corresponding one of the parasitic reflectors (18, 20, 22). For example, each step (125, 127, 129) may support the parasitic reflectors (18, 20, 22) from a bottom or central region of the parasitic reflector around its central bore 301.

In an alternate embodiment, each parasitic reflector (18, 20, 22) may be affixed to a central dielectric supporting structure 124 via a nut (e.g., different nuts, where the lower nut has a greater diameter than an upper nut) that mates with threads on the cylindrical portions of the structure 124 to bind each parasitic reflector (18, 20, 22) between a respective nut and a corresponding step or shoulder (125, 127, 129) of the central dielectric supporting structure 124.

Figure 4:
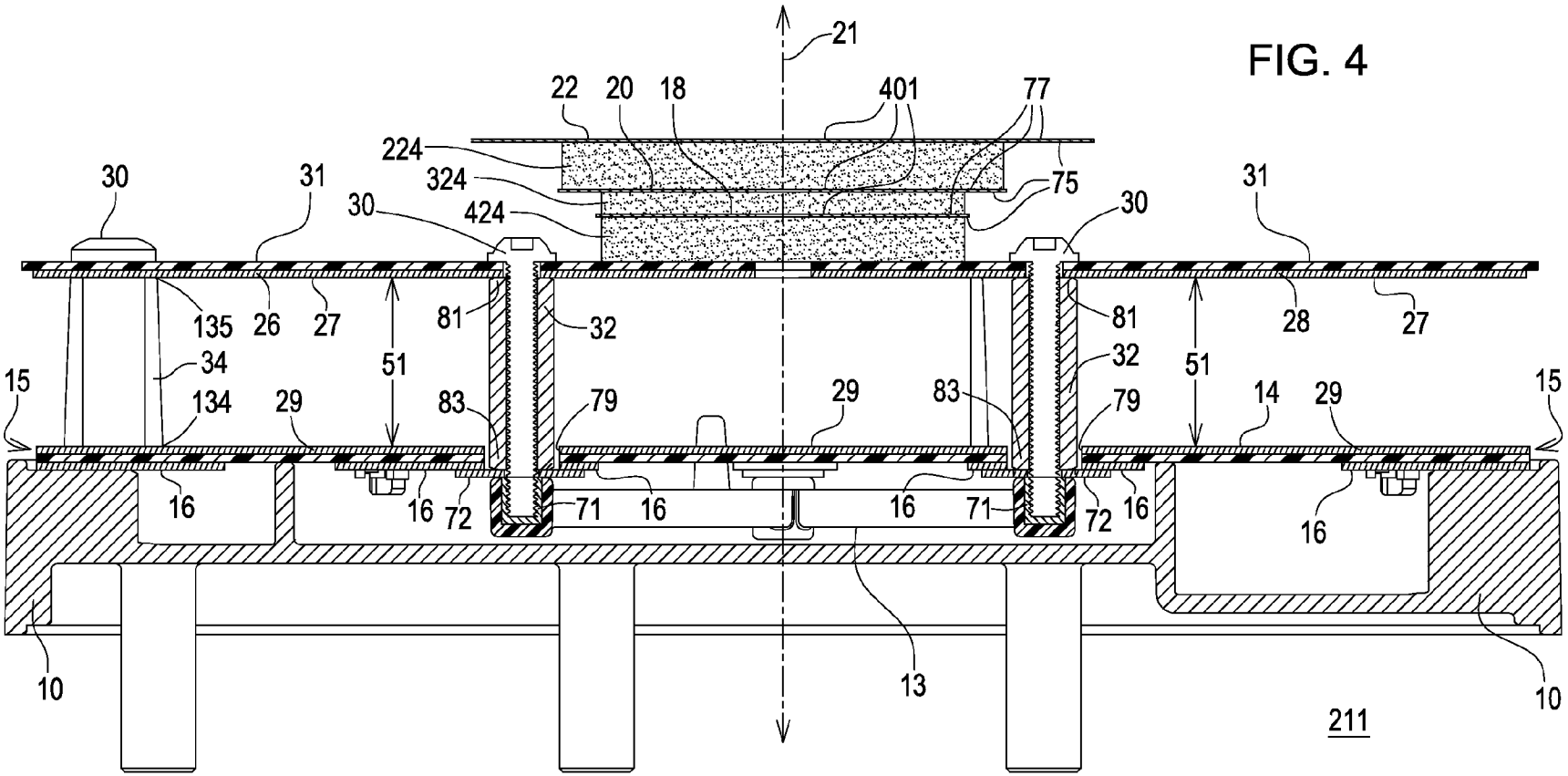
FIG. 4 is another alternate embodiment of a supporting structure for the parasitic reflectors.

The antenna 211 of FIG. 4 is similar to the antenna 11 of FIG. 1B, where the supporting structure 24 of the parasitic reflectors (18, 20, 22) is replaced by an alternate supporting structure of dielectric layers (224, 324 and 424) or dielectric foam layers. For example, each dielectric layer (224, 324, and 424) may be composed of polystyrene or another dielectric material of a desired height or thickness to provide a target separation between adjacent or facing parasitic reflectors (18, 20, 22) and to provide a target separation from a central portion 401 of the radiators (26, 28, 126, 128) near the central axis 21 of the antenna 211.

In one configuration, the alternate dielectric supporting structure of FIG. 4 comprises first dielectric layer 424 between a central zone 401 of the antenna 211 and closest parasitic reflector (18), a second dielectric layer 324 between the closest parasitic reflector (18) and an intermediate parasitic reflector (20) and a third dielectric layer 224 between the intermediate parasitic reflector (20) and the farthest possible parasitic reflector (22), where the closest parasitic reflector is synonymous with the first parasitic reflector 18 or the parasitic reflector that is closest to a central portion 401 above the radiators.

In one embodiment, the parasitic reflector or reflectors (18, 20, 22) may be supported by one or more corresponding dielectric layers (e.g., dielectric foam layers) that are associated with or that underlie a central region of each parasitic reflector near the axis 21. For example, parasitic reflector (18, 20, or 22) may be affixed to or adhesively bonded to a corresponding dielectric foam layer of a desired thickness: (1) (e.g., vertical thickness) to separate the adjacent parasitic reflectors (18, 20, 22), (2) to separate the first parasitic reflector 18 from the radiators 27, or (3) to produce a desired degree or level of coupling between the radiators and one or more parasitic reflectors to optimize the AR.

As illustrated in FIG. 4, a first dielectric layer 424 overlies a central region 401 of dielectric layer 31, while the first dielectric layer 424 adjoins and supports the first parasitic reflector 18. A second dielectric layer 324 overlies at least a central region of the first parasitic reflector 18, while the second dielectric layer 324 adjoins and supports the second parasitic reflector 20. A third dielectric layer 224 overlies at least a central region 401 of the second parasitic reflector 20, while the third dielectric layer 224 adjoins and supports the third parasitic reflector 22.

FIG. 5 is a block diagram of an antenna system consistent with the antenna 11 of FIG. 1A through FIG. 1E, inclusive. Like reference numbers indicate like elements in FIG. 1A through FIG. 1E, inclusive, and FIG. 5. In alternate configurations, the antenna system may comprise an antenna 11, antenna 111 or antenna 211, for example.

In accordance with FIG. 5, an antenna system comprises an interface system 571 coupled to the antenna 11. In one embodiment, the interface system 571 may comprise a plurality of impedance matching networks 507 coupled to corresponding radiators (26, 28, 126, 128) of the antenna 11 via feeding members 32. At input nodes 602, each one of the respective impedance matching networks 507 is coupled to a corresponding one of the radiators (26, 28, 126, 128) for matching the impedance (e.g., reactive impedance) of each radiator to a target impedance (e.g., 50 ohms or 75 ohms) at output nodes 601 of the impedance matching networks 507. In one configuration, each of the impedance matching networks 507 comprises one or more tuned circuits (e.g., 603 in FIG. 6) comprising a capacitor and an inductor (e.g., series or parallel tuned circuits).

In turn, the impedance matching networks 507 are coupled to a combiner 501. In one embodiment, the antenna system comprises a combiner 501 having primary ports (502, 503, 504, 505) coupled to the output nodes 601 of the respective impedance matching networks 507 and a secondary port 511 for interfacing with a satellite navigation device (e.g., a receiver, transmitter or low noise amplifier (LNA) for a receiver, such as receiver 900 of FIG. 9). In one configuration, the combiner 501 accepts signal components of different phases that are offset by approximately 90 degrees at the primary ports (502, 503, 504, 505); the combiner 501 outputs a composite signal at the secondary port 511 that contains each of the signal components. For example, in FIG. 5 a first port 502 has a received signal with a first phase of approximately 0 degrees; a second port 503 has a second phase of approximately 90 degrees; a third port 504 has a third phase of approximately 180 degrees, and a fourth port 505 has a fourth phase of approximately 270 degrees, where the combiner 501 can shift the phases with phase shifters, hybrids, ferrite toroidal transformers, or other devices to produce an aggregate or composite received signal. With respect to the secondary port 511 of the combiner, the satellite navigation device comprises or more of the following devices: a navigation satellite receiver, a navigation satellite transmitter or transceiver.

In one configuration of the antenna system, the radiators (26, 28, 126 and 128) are arranged to provide phase-offset signal components of a received electromagnetic signal (e.g., satellite signal or satellite navigation signal) by relative orientation of the each radiator with respect to an adjacent radiator in a clockwise or counter-clockwise direction about the central axis 21. In one embodiment, a curved edge 63 of each of the radiators (26, 28, 126 and 128) faces clockwise about a central axis 21 of the antenna 11, where a rectilinear edge 61 of each of the radiators (26, 28, 126, 128) is opposite or adjoins the curved edge 63. In another embodiment, the curved edge 63 has a generally rectangular notch and wherein the curved edge is generally elliptical or generally circular.

As shown in FIG. 5, each feeding member 32 has a generally polygonal cross section, such as a hexagonal cross section. In an alternate embodiment, the feeding member 32 has a generally circular cross section. The grounded member 34 has a generally rectangular cross section, for instance.

To efficiently receive right handed circularly polarized (RHCP) radiation the feeding members 32 (e.g., four hexagonal drive posts) can be processed by an analog microwave or radio frequency (RF) circuit on the bottom side of the ground plane 14, where at least a portion of the a circuit board 15 or substrate forms the ground plane 14. In one embodiment, one or more impedance matching networks 507 are mounted on the circuit board 15 on an opposite side (e.g., on a bottom side of the circuit board 15) from the side that the radiators face. Each matching network 507 can be coupled to the corresponding radiators (26, 28, 126, 128). Each matching network 507 provides matching or conversion of impedance characteristics of the received or transmitted electromagnetic signal to a target impedance (e.g., 50 ohms) for the combiner 501. In one example, the output impedance of the matching network 507 is substantially 50 ohms at the output nodes 601. Next the four signals are fed to a combiner 501 (e.g., quadrature combining network), as shown in FIG. 5. The combiner 501 may comprise a phase shifter, combiner or hybrid modules to maximize the received signal power from an RHCP receive signal.

Figure 6:
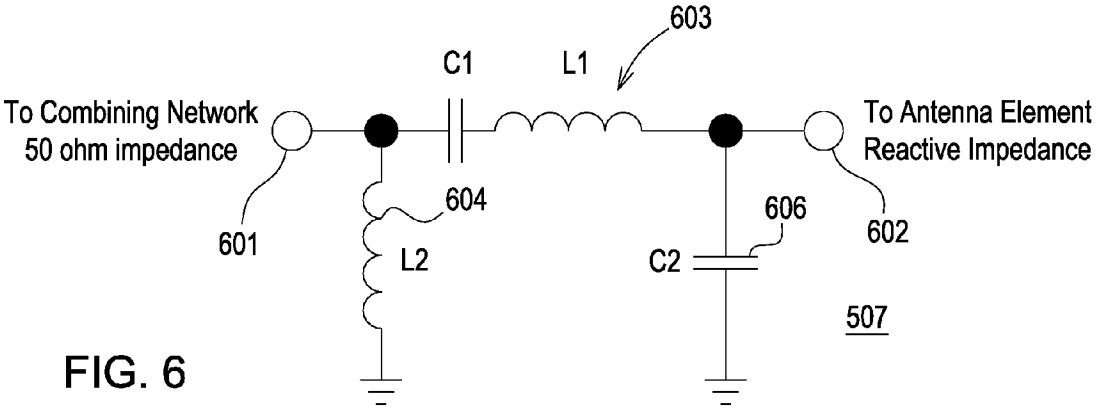
FIG. 6 is a schematic of an illustrative embodiment of a matching network.

FIG. 6 discloses one possible illustrative embodiment of an impedance matching network 507, consistent with the block diagram of FIG. 5. Like reference numbers in FIG. 5 and FIG. 6 indicate like elements.

An input node 602 (or first terminal) of the impedance matching network 507 has a capacitor 606 C2 that may counteract, at least partially, the inductance associated with the respective radiator (e.g., 26, 28, 126, or 128) over the frequency range or band of the received signal. The input node 602 functions as an input terminal in the receive mode. The impedance matching network 507 is well suited for compensating for the reactive inductance of the radiators (26, 28, 126, 128) of the antenna (11, 111, or 211).

The impedance matching network 507 comprises a series tuned circuit 603. In turn, the series tuned circuit 603 comprises a capacitor (C1) coupled in series to an inductor (L1), where the tuned circuit provides a pass-band frequency versus amplitude response at or near a desired resonant frequency (e.g., target receive signal or receive signal band).

An output node 601 (e.g., second terminal) of the impedance matching network 507 is coupled one terminal of capacitor (C1) and one terminal of an inductor 604 (L2). The output node 601 is an output terminal of the impedance matching network 507 in the reception mode. An opposite terminal of the inductor 604 (L2) is connected to ground such that lower frequency or direct current signals are shunted to the ground, which provides a high-pass frequency versus amplitude response for the received signal inputted at input nodes 602. This high-pass frequency response is cumulative with the pass-band frequency response provided by the series tuned circuit 603. The second terminal 601 presents a target impedance (e.g., approximately 50 ohms) to the combiner 501.

Based on the frequency range of operation of the antenna 11 for a Global Positioning System (GPS) or another satellite navigation system, the inductors L1 and L2 may comprise microstrip or striplines formed or defined, at least partially, by the conductive traces 16 on a circuit board 15, whereas the capacitors C1 and C2 may comprise chip or surface mounted capacitors with minimal lead length, for example.

Figure 7:
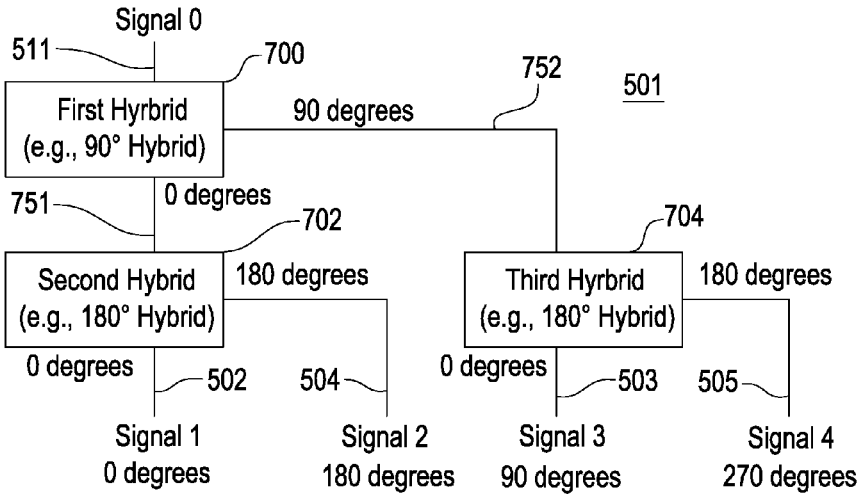
FIG. 7 is a block diagram of a combiner or combining network.

FIG. 7 comprises an illustrative combiner 501 consistent with FIG. 5. As illustrated, the combiner 501 comprises a plurality of hybrids, including a first hybrid 700 that provides a first output port 751 with 0 degrees phase shift and a second output port 752 with a 90 degrees phase shift with respect to an input signal at secondary port 511. The first hybrid 700 is coupled to a second hybrid 702 and a third hybrid 704. As indicated the second hybrid 702 and the third hybrid 704 each provide two output ports: an in-phase output port with 0 degrees of phase shift with respect to an input signal and opposite-phase output port (or anti-phase output port) with 180 degrees of phase shift with respect to an input signal. The first output port 751 is coupled to the second hybrid 702, whereas the second output port 752 is coupled to the third hybrid 704. The in-phase output port of the second hybrid 702 is coupled to the output node 502; the opposite-phase or anti-phase port of the second hybrid 702 is coupled to the output node 504. The in-phase output port of the third hybrid 704 is coupled to the output node 503; the opposite-phase or anti-phase port of the second hybrid 702 is coupled to the output node 505.

Figure 8:
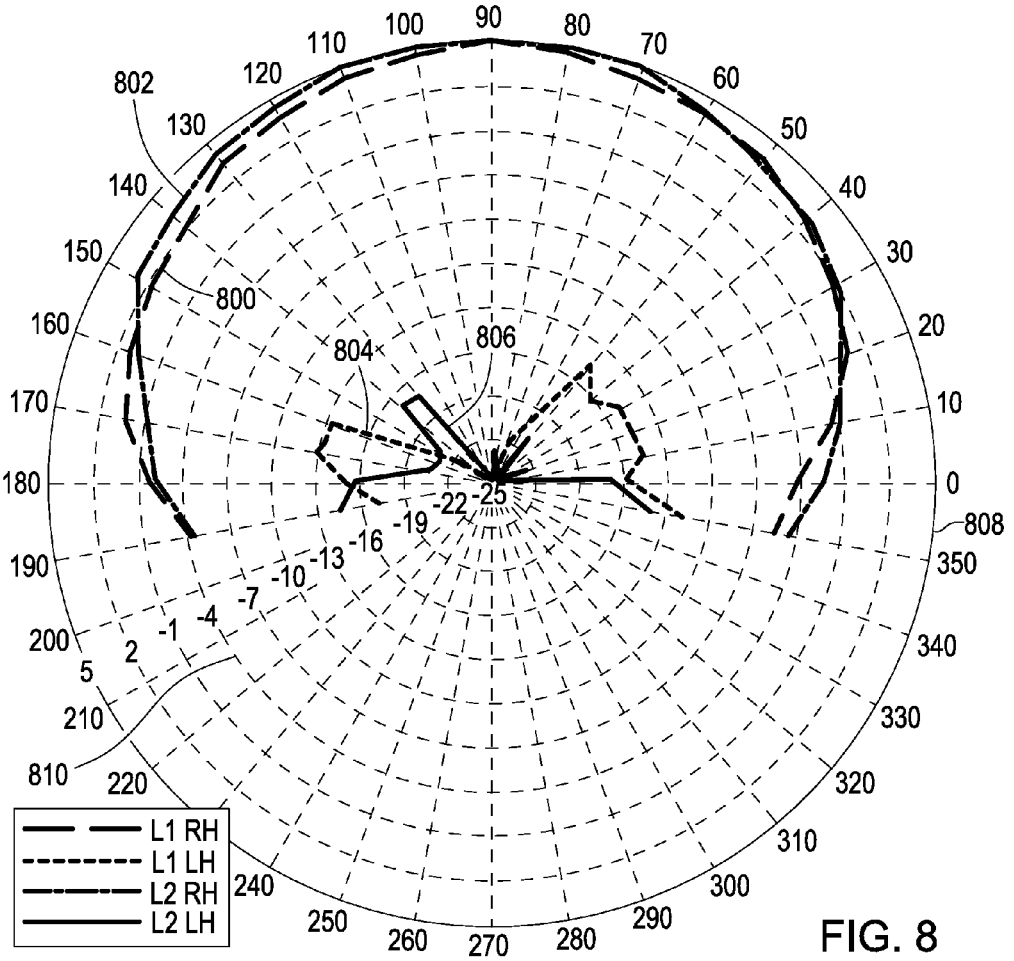
FIG. 8 is a diagram of an illustrative radiation pattern associated with the antenna in accordance with this disclosure.

FIG. 8 illustrates possible illustrative radiation patterns that are possible with respect to the antenna (11, 111, or 211) of the disclosure. If the feeding members 32 are coupled to a combiner 501 (e.g., a quadrature combiner) through appropriate impedance matching networks 507, one or more radiation patterns of FIG. 8 can result, for instance.

In a polar chart, FIG. 8 illustrates the gain of the antenna versus azimuth for various polarizations, where each concentric circle in dashed lines indicates a corresponding discrete gain level of the radiation pattern, expressed in Decibels, and where the outer edge indicates the azimuth of the radiation pattern, expressed in degrees. Here, the illustrative gain of the antenna versus azimuth is illustrated for the following polarizations of received or transmitted signals: (1) right-hand circular polarization (RHCP) for the L1 frequency GPS signal (L1 RH), (2) left-hand polarization (LHCP) for the L1 GPS signal (L1 LH), (3) right-hand circular polarization (RHCP) for the L2 frequency GPS signal (L2 RH), and (4) left-hand circular polarization (LHCP) for the L2 frequency GPS signal (L2 LH). The polar chart shows that the isotropic right-hand circularly polarized gain for GPS L1 (1575 MHz) and GPS L2 (1227 MHz) is fairly uniform over the upper hemisphere. The chart also shows that the gain for left-hand circular polarization is much lower than for right-hand circular polarization, such that the left-hand circular polarization received signals are attenuated or rejected by the antenna (11, 111 or 211). However, it is understood that the left-hand circular polarization could be favored over right-hand circular polarization, if desired, by changing the orientation of the radiators (26, 28, 126, 128) and by changing their respective connections to the combiner or combining network.

Figure 9:
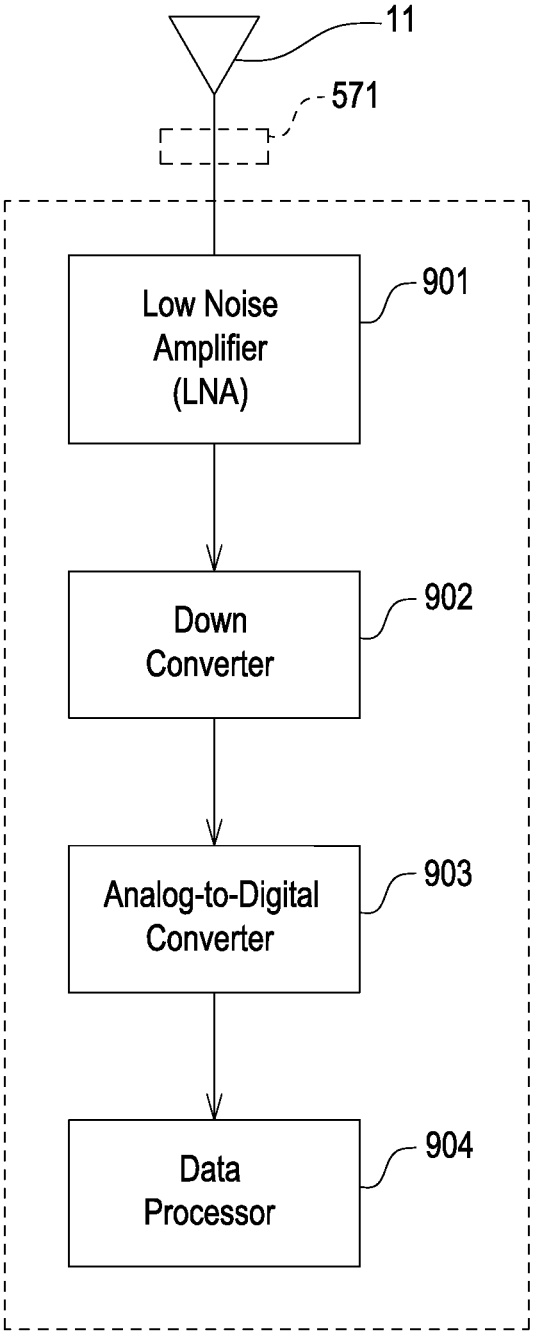
FIG. 9 is a block diagram of a satellite navigation receiver coupled to the antenna.

FIG. 9 illustrates an antenna (11, 111 or 211) coupled to interface system 571. In turn, the interface system 571 is coupled to receiver 900. Like reference numbers in FIG. 5 and FIG. 9 indicate like elements.

In one embodiment, the receiver 900 comprises a satellite navigation receiver or a location-determining receiver, such as a GPS receiver. The receiver 900 comprises a low-noise amplifier 901, a down converter 902, an analog-to-digital converter 903, and a data processor 904.

The low-noise amplifier (LNA) 901 comprises an analog radio frequency amplifier or microwave amplifier for amplifying a received signal provided from the antenna (11, 111, or 211) via the interface system 571, or its secondary port 511. In one configuration, the low-noise amplifier 901 is coupled to a down converter 902 for down-converting a received signal at a received frequency to an intermediate frequency signal or a baseband frequency signal.

In one embodiment, the down converter 902 may comprise a local reference oscillator and a mixer that mixes the locally generated signal with the received signal for down-conversion. The down converter 902 is coupled to an analog-to-digital converter 903.

As shown, analog-to-digital converter 903 is arranged to convert the intermediate frequency signal or the baseband frequency signal to a digital intermediate frequency signal or a digital baseband frequency signal. The analog-to-digital converter 903 is coupled to a data processor 904.

In one embodiment, the data processor 904 may comprise a microprocessor, a microcontroller, a programmable logic array, a programmable logic device, a digital signal processor, an application specific integrated circuit, or another electronic data processing system. The data processor 904 is configured to decode or demodulate at least part of the received signal, to track the carrier phase of the received signal, or to otherwise process received signals received from one or more satellites to estimate a location of receiver 900, and more specifically its antenna (11, 111, 211).

The antenna (11, 111, or 211) described in this document is well suited for a high precision Earth-based Global Satellite Navigation (GNSS) receiver. Medium to low precision GNSS receivers such as those found in automobile navigation systems and cellular telephone handsets are less demanding in their antenna performance requirements. The antenna (11, 111 or 211) described in this document can provide uniform isotropic gain in the upper hemisphere of +3 dBi and no gain at elevation angles below the horizon; reception of signals with right hand circular polarization (RHCP), as opposed to left hand circular polarization; and low variation of gain with respect to frequency (i.e. flat frequency response). The antenna of the disclosure can be readily manufactured in a relatively compact size of low weight, for example.

Having described the preferred embodiment, it will become apparent that various modifications can be made without departing from the scope of the invention as defined in the accompanying claims. For example, one or more of any dependent claims set forth in this document may be combined with any independent claim to form any combination of features set forth in the appended claims, and such combination of features in the claims are hereby incorporated by reference into the specification of this document.

The following is claimed:

1. An antenna comprising:

a plurality of notched radiators that are semi-elliptical or partly elliptical, each of the plurality of radiators having a first substantially planar surface and a curved edge with a notch, the plurality of radiators being arranged to provide phase-offset signal components of a received electromagnetic signal by relative orientation of each radiator with respect to an adjacent radiator in a clockwise or counter-clockwise direction about a central axis of the antenna, and a rectilinear edge of each of the plurality of radiators being opposite the curved edge;

a ground plane having a second substantially planar surface that is generally parallel to the first substantially planar surfaces of the radiators by a generally uniform spacing;

at least one parasitic reflector above the notched radiators and spaced apart from the notched radiators, where the at least one parasitic reflector improves the axial ratio of the antenna by controlled electromagnetic coupling between the radiators;

a plurality of feeding members for conveying an electromagnetic signal to or from a corresponding one of the plurality of radiators, each of the feeding members being below the parasitic reflector and spaced radially outward from the central axis of the antenna; and a plurality of grounded members, each grounded member coupled to a corresponding one of the radiators and spaced apart, radially outward from a corresponding one of the feeding members.

2. The antenna according to claim 1 further comprising:

a plurality of parasitic reflectors having corresponding periphery portions; and a dielectric supporting structure for supporting the parasitic reflectors such that the parasitic reflectors are spaced apart from the notched radiators, the dielectric supporting structure having slots or recesses for engaging the corresponding periphery portions.

3. The antenna according to claim 1 further comprising:

a plurality of parasitic reflectors having corresponding periphery portions; and a dielectric supporting structure for supporting the parasitic reflectors such that the parasitic reflectors are spaced apart from the notched semi-elliptical radiators, the dielectric supporting structure comprising a central post with steps, where each step is configured to secure a corresponding one of the parasitic reflectors.

4. The antenna according to claim 1 further comprising:

a plurality of parasitic reflectors having corresponding periphery portions; and a dielectric supporting structure for supporting the parasitic reflectors such that the parasitic reflectors are spaced apart from the notched radiators, the dielectric supporting structure comprising a first dielectric layer between a central zone of the antenna and a closest parasitic reflector, a second dielectric layer between the closest parasitic reflector an intermediate parasitic reflector, and a third dielectric layer between the intermediate parasitic reflector and the farthest parasitic reflector.

5. The antenna according to claim 1 wherein the curved edge of each of the radiators faces clockwise about the central axis of the antenna, where clockwise is observed from above the antenna.

6. The antenna according to claim 5 wherein the notch comprises a generally rectangular notch and wherein the curved edge is generally elliptical or generally circular.

7. The antenna according to claim 1 wherein the feeding member has a generally polygonal cross section with five or more sides.

8. The antenna according to claim 1 wherein the feeding member has a generally circular cross section.

9. The antenna according to claim 1 wherein the grounded member has a generally rectangular cross section.

10. The antenna according to claim 1 further comprising:

a plurality of impedance matching networks, each one of the respective impedance matching networks coupled to a corresponding one of the radiators for matching the impedance of each radiator to a target impedance at output nodes of the impedance matching networks.

11. The antenna according to claim 10 further comprising:

a combiner having primary ports coupled to the output nodes of the respective impedance matching networks and a secondary port for interfacing with a satellite navigation device.

12. The antenna according to claim 1 wherein the at least one parasitic reflector comprises a disk.

13. An antenna system comprising:

a plurality of notched radiators that are semi-elliptical or partly elliptical, each of the plurality of radiators having a first substantially planar surface and a curved edge with a notch, the plurality of radiators being arranged to provide phase-offset signal components of a received electromagnetic signal by relative orientation of each radiator with respect to an adjacent radiator in a clockwise or counter-clockwise direction about a central axis of the antenna, and a rectilinear edge of each of the plurality of radiators being opposite the curved edge;

a ground plane having a second substantially planar surface that is generally parallel to the first substantially planar surfaces of the radiators by a generally uniform spacing;

at least one parasitic reflector above the notched and spaced apart from the notched, where the at least one parasitic reflector improves the axial ratio of the antenna by controlled electromagnetic coupling between the radiators;

a plurality of feeding members for conveying an electromagnetic signal to or from a corresponding one of the plurality of radiators, each of the feeding members being below the parasitic reflector and spaced radially outward from the central axis of the antenna;

a plurality of grounded members, each grounded member coupled to a corresponding one of the radiators and spaced apart, radially outward from a corresponding one of the feeding members;

a plurality of impedance matching networks, each one of the respective impedance matching networks coupled to a corresponding one of the radiators for matching the impedance of each radiator to a target impedance at output nodes of the impedance matching networks; and a combiner having first ports coupled to the output nodes of the respective impedance matching networks and a second port for interfacing with a satellite navigation device.

14. The antenna system according to claim 13 further comprising:

a plurality of parasitic reflectors having corresponding periphery portions; and a dielectric supporting structure for supporting the parasitic reflectors such that the parasitic reflectors are spaced apart from the notched radiators, the dielectric supporting structure having slots or recesses for engaging the corresponding periphery portions.

15. The antenna system according to claim 13 further comprising:

a plurality of parasitic reflectors having corresponding periphery portions; and a dielectric supporting structure for supporting the parasitic reflectors such that the parasitic reflectors are spaced apart from the notched radiators, the dielectric supporting structure comprising a central post with steps, where each step is configured to secure a corresponding one of the parasitic reflectors.

16. The antenna system according to claim 13 wherein the combiner accepts signal components of different phases that are offset by approximately 90 degrees at the first ports and outputs a composite signal at the second output port that contains each of the signal components.

17. The antenna system according to claim 13 wherein the satellite navigation device comprises a navigation satellite receiver.

18. The antenna system according to claim 13 wherein each of the impedance matching networks comprises one or more tuned circuits comprising a capacitor and an inductor.

19. The antenna according to claim 13 wherein the curved edge of each of the radiators faces clockwise about the central axis of the antenna.

20. The antenna according to claim 19 wherein notch comprises a generally rectangular notch and wherein the curved edge is generally elliptical or generally circular.

21. The antenna according to claim 13 wherein the feeding member has a generally polygonal cross section with five or more sides.

22. The antenna according to claim 13 wherein the feeding member has a generally circular cross section.

23. The antenna according to claim 13 wherein the grounded member has a generally rectangular cross section.

24. The antenna according to claim 13 wherein the at least one parasitic reflector comprises a disk.

25. An antenna comprising:

a plurality of notched semi-elliptical radiators, each of the radiators having a first planar surface;

a ground plane having a second planar surface that is parallel to the first planar surfaces of the radiators by a uniform spacing, the ground plane having a central axis, a plurality of feeding members for conveying an electromagnetic signal to or from a corresponding one of the plurality of radiators, each of the feeding members spaced radially outward from the central axis of the ground plane; and a plurality of grounded members, each grounded member coupled to a corresponding one of the plurality of radiators and spaced apart, radially outward from a corresponding feeding member of the plurality of feeding members, wherein:

the radiators are arranged to provide phase-offset signal components of a received electromagnetic signal by relative orientation of each radiator with respect to an adjacent radiator in a clockwise or counter-clockwise direction about the central axis;

a curved edge of each of the radiators faces clockwise about a central axis of the antenna and wherein a rectilinear edge of each of the radiators is opposite the curved edge, where clockwise is observed from above the antenna; and the curved edge has a generally rectangular notch and wherein the curved edge is elliptical or circular.

* * * * *